United States Patent [19]

Backus et al.

[11] 3,967,815

[45] July 6, 1976

[54] DUSTLESS MIXING APPARATUS AND METHOD FOR COMBINING MATERIALS

[76] Inventors: James H. Backus, 3320 Franconia Road, Alexandria, Va. 22310; Charles E. Cornwell, 7104 Marlan Drive, Alexandria, Va. 22307

[22] Filed: Aug. 27, 1974

[21] Appl. No.: 500,956

[52] U.S. Cl. ..... 259/148; 259/8; 259/165; 259/178 R

[51] Int. Cl.[2] ..... B28C 5/46

[58] Field of Search ..... 259/146, 147, 148, 178 A, 259/8, 18, 23, 24, 7, 21, 42, 43, 44, 164, 165

[56] References Cited

UNITED STATES PATENTS

| | | | |
|---|---|---|---|
| 760,651 | 5/1904 | Schwarz | 259/153 |
| 886,768 | 5/1908 | Bogory | 259/153 |
| 1,660,280 | 2/1928 | Thomson | 259/146 |
| 2,942,860 | 6/1960 | Ridley | 259/178 |
| 3,231,245 | 1/1966 | Harvey | 259/153 |
| 3,395,897 | 8/1968 | Kalich | 259/178 R |

*Primary Examiner*—Robert W. Jenkins
*Attorney, Agent, or Firm*—Wilfred G. Caldwell

[57] ABSTRACT

This invention consists of a mixing method for dustless dry cementitious compositions and apparatus for combining materials without loss or escape of dust.

17 Claims, 6 Drawing Figures

DUSTLESS MIXING APPARATUS AND METHOD FOR COMBINING MATERIALS

SUMMARY OF THE INVENTION

This invention relates to a method for mixing a wide range of materials without creating dust problems that may adversely affect the environment or personal health, and without loss of useful dust.

More particularly, the system has all sealed containers and pipe transfer methods that prevent any dust from escaping.

The customary method of mixing, e.g. cementitious material is well known, as by the standards of ready mix trucks and conventional concrete drum mixers. Considerable amounts of dust may be seen around these conventional mixing or batching plants when operating.

This invention uses one or more of a new type of impeller in the shape of a circular concave section mounted centrally on a shaft which is rotated at relatively high speeds for the efficient combining and equal dispersion of dissimilar materials through the establishment of a vortex in the materials being mixed. Such an impeller is disclosed in U.S. patent application Ser. No. 392,643, filed Aug. 27, 1973 by C.E. Cornwell and Mark Plunguian, and entitled Mixing and Aerating Device, and is not claimed herein as an invention, but rather as a part of the entire system.

In addition there is used a second and/or third impeller stacked with the first impeller above the bottom of the mixing container and attached centrally on the same shaft as the first impeller. These additional impellers extend the vortex to the bottom of the container which prevents any build-up of cementitious materials and helps start circular motion of materials. The primary or vapor impeller creates a vortex which has a very high vacuum area related to the rotational speed and impeller diameter.

The cementitious materials are pulled down towards the vortex vacuum and immediately explode into dissimilar materials, causing them to combine into an equally dispersed product ready for its ultimate use. The impeller creates a smooth mix without mechanical energy heat transfer to the material.

Conventional mixers do not combine cementitious materials without some problems. Most common of these problems is uneven dispersion and balling up of dissimilar materials.

In the preferred apparatus, the impellers are located in a cylindrical container and have diameters approximately two thirds of the container diameter. Spray water cleans the container and is metered in combination with mixing water in predeterminable ratio to the cement. Container air is exhausted and filtered as materials enter the container and the dust is received from the filter. The output slurry is introduced to conveyed sand and gravel in a conventional mixer.

This mixing system is designed for continuous operation and is self-cleaning. Recycle time can be varied from 2 minutes or more. The sequence of events is as follows:

1. The precise amount of water or prepared fluids is metered into the mixing container and the impellers start rotating. The water being fed into the container passes through the air filtering system which washes the air filter clean on each recycle. The high rotational speed of the primary impeller (aided by others when used) causes the water or prepared fluid to circulate violently, thereby cleaning the bottom and sides of the container on each recycle.

2. A water or prepared fluid spray ring is located at the top inside of the container and is set in such a manner as to spray and wash the top of the container and all other exposed parts where the various materials may stick. This ring is also another source for metering special chemicals for admixing to the cementitious materials at the correct time. This fluid is pressurized by a pump set for relatively high pressure for thorough cleaning action. The small holes in the spray ring are placed in precise directional areas for spraying the top and other functional parts.

3. The above function requires from 5 to 30 seconds and the cementitious composition is then metered into the container from one or more sources where it is immediately pulled down to the vortex and combined with dissimilar materials. A slight vacuum is drawn automatically when material is metered in to help carry away the air that is displaced by the material. This reduces any possible chance of back pressure or blowback. The vacuum pump is located just above the water or prepared fluid entrance into the mixing container. The storage tanks and their capacities are only limited to those specific requirements which are determined by the materials to be mixed. A water tank, chemical tank, admix tank and cementitious tank is normal for this type of mixing system. Of course, these materials may be in powder or fluids as required. The mixing time for combining dissimilar materials is normally 30 seconds after all materials are in the container. However, mixing times can be adjusted to meet the technical requirements of the composition and desired effects on same.

4. When the above mixing procedure is completed, a dump valve is opened and the material will flow or can be pumped to its intended use. In one example, a cementitious material is metered into a rotating or static vaned pipe to cover aggregates tumbling or conveyed down the pipe from another source, such as a hopper or conveyor belt system; the result being a prepared concrete ready for placement or transporting to the job site. When the container is empty the dump valve is closed and ready for recycling.

The impeller mixer is excellent for combining cementitious material with lightweight aggregates, chemicals and foaming chemicals, concentrates for controlled densities and strengths. However, it is not limited to cementitious products and it is highly efficient for mixing paints and most other items that require mixing when in a fluid state.

The entire system and sequence of events can be computerized for full automation or manually operated. Computerized systems for metering, weighing, and mixing are well known in the trades and are not considered as any new innovation.

In summary, the invention offers the following important advantages:

1. Speed of mixing the slurry is very rapid as a result of the vortex-type mixer/mixing, and a normal batch time for mixing Portland cement and water may run on the order of 2 minutes.

2. There is no shear involved in the vortex-type mixer/mixing and therefor there is no transfer of mechanical energy into chemical heat which prevents flash setting. As a result of the absence of blades or paddles the cement and water are formed by the vortex into a creamy slurry without heat because of the more effective use of cement by proper combination thereof, i.e., hydration.

3. The absence of balling. Due to the effectiveness of the vortex mixing there are no small particles of dry cement surrounding the water cement to ball up as is frequently encountered in conventional mixers. Thus, in conventional mixers, in an attempt to avoid balling, the rpm is increased to beat the mixture at a high rate, but this develops cavitation and extra mechanical energy is transformed into chemical heat energy, thereby inviting flash setting.

4. The provision of a dustless mixing method and system wherein it is believed that between 2% and 5% of the cement is saved and the environment accordingly improved.

5. The vortex mixing arrangement, both in method and apparatus permits the addition of additives for foaming or directly entraining more efficiently because of the better mixing.

6. The self-cleaning mixing chamber permits ready recylcing without extra steps, which is occasioned by the ring of high pressure spray emanating from oriented holes to reach all parts of the barrel or container, using spray water being metered and taken into account with the added water for forming the slurry.

7. The further provision of the self-cleaning filter system which permits use of the trapped dust upon each recycling, and is automatically cleaned.

8. The use of a second mixer for the combining of cementitious slurries with aggregates or fillers. The secondary mixer may be a ready-mix truck, drum or paddle mixers or standard well-known mixing methods which do not require high rpm, as the creamy slurry is already homogenized.

Throughout the specification the use of the word cementitious is intended to cover the combining of dissimilar materials whether or not they contain cement, such as flour and water, paint mixing, foaming, dry mixing and the like.

Figure 1:
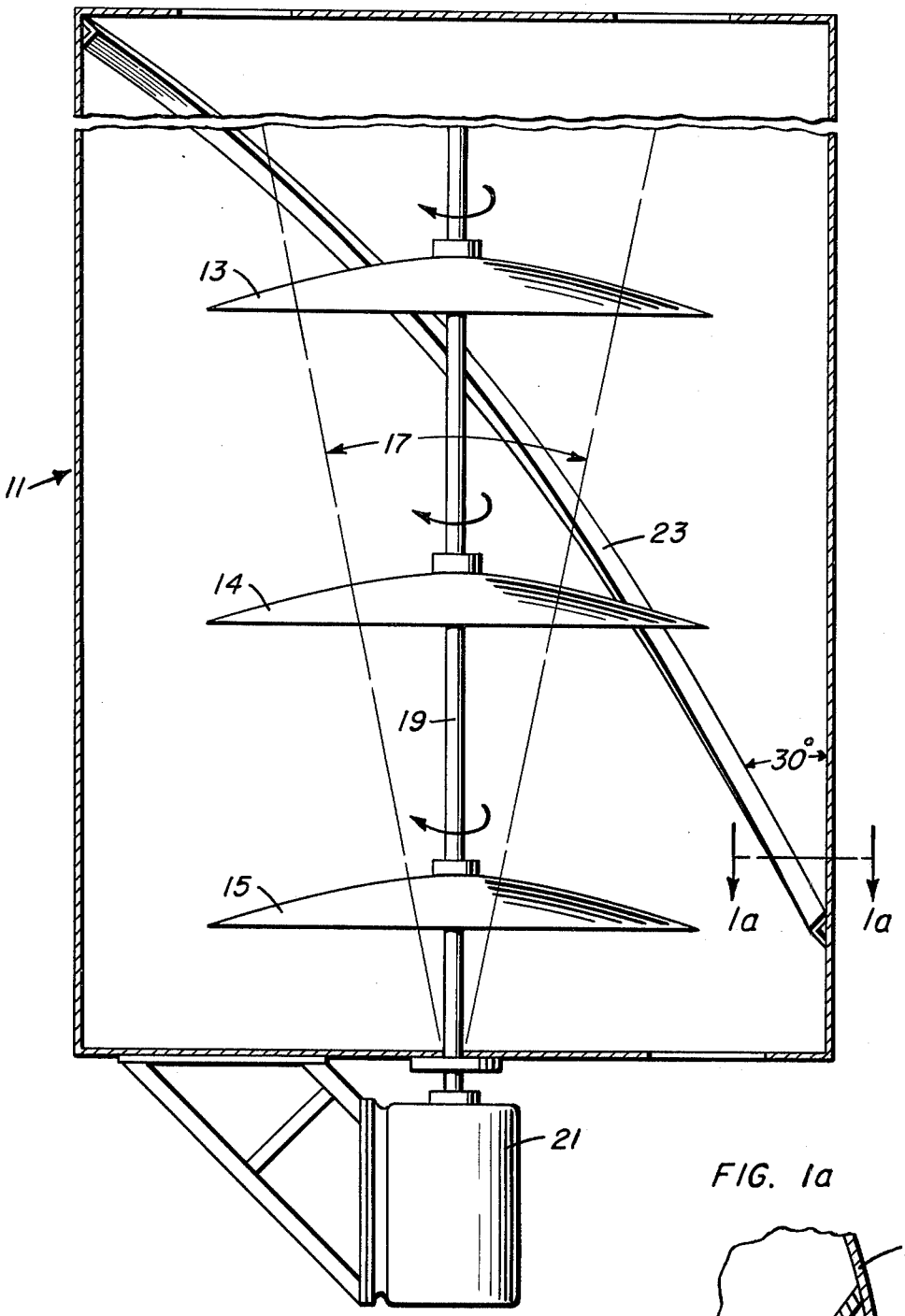
FIG. 1 and 1*a* is a view partly in section and partly in elevation to show the mixing container impellers and vortex therein.
Figure 1A:
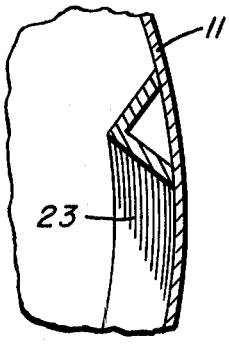

In the mixing tank or container 11 of FIG. 1 there are shown three impellers 13, 14 and 15 creating the vortex 17. The use of a single impeller 13 is suitable but the vortex 17 does not extend all the way to the bottom of the container 11 and, thus, cementitious material may tend to pile up in the vicinity of the common shaft 19. The purpose of the auxiliary impellers 14 and 15 is to extend the vortex 17 to the floor of the container 11 and ensure 100% mixing.

The container may be any standard cylinder of steel or other material rigid enough to withstand the forces encountered. The diameter of the impellers is preferably of the order of two-thirds of the barrel or container diameter. By way of example, in FIG. 1 the barrel may have a diameter of 22–24 inches. The impellers are spaced preferably with the lower impeller approximately 4 inches above the barrel floor and the next two impellers spaced 8 inches apart, and their diameters are of the order of 16 inches.

The driving motor 21 should be of sufficient horsepower to attain a preferred tip speed of 30 miles per hour of the impellers and this depends upon the viscosity of the materials being mixed.

A vane 23, preferably of angle iron, is bent around the outside of the barrel to fit within the barrel thereof, being welded against the side and may extend of the order of 180° about the barrel periphery. An angle of the order of 30° is preferred between the vertical and the vane. The shape of the vane 23 forces the rotating fluids and materials back towards the center of the primary mixing impeller.

The mixer is completed by mounting the motor 21 on a suitable frame 23 and providing conventional bearings for shaft 19. Of course, the larger the barrel, the larger the impeller diameter and the further the impellers are located from the bottom.

Figure 2:
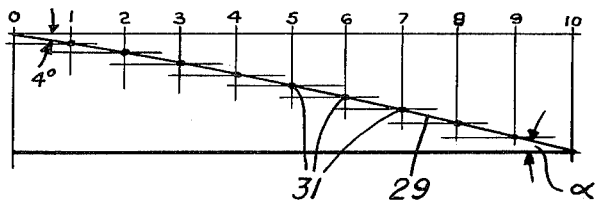
FIG. 2 is a construction chart showing the method of construction of the impeller.

A typical method of constructing the concave configuration of the impellers is shown in FIG. 2, wherein the abscissa is divided into ten equal parts and a curve 29 is drawn by dropping a 4° angle from the vertical at each incremental unit to establish the dots 31, through which a curve is drawn to form a quadrant of the impeller which is symmetrical. It has been found that if the angle alpha exceeds 45°, the material begins to hang up and the mixing is less efficient.

Figures 3, 4A:
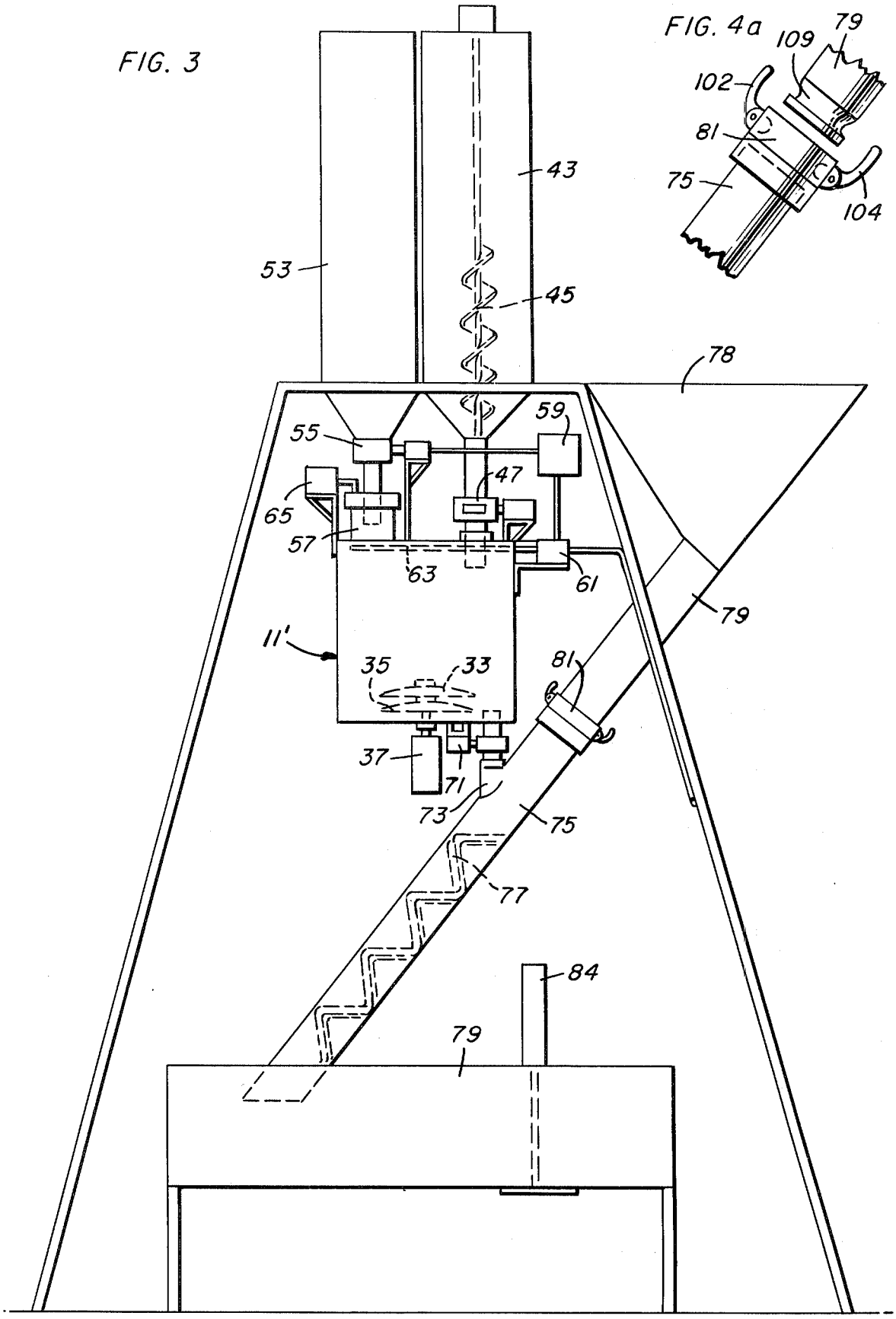
FIG. 3 illustrates the apparatus for the mixing of a creamy slurry and application to sand and gravel.
FIG. 4*a* is a detailed showing of the couplings.

In FIG. 3 a complete mixing system is shown wherein the container 11′ may be identical to that described in connection with FIG. 1 or may include only a pair of impellers 33 and 35, as illustrated. A 57 horsepower motor 37 drives these impellers at approximately 400 rpm when the container 11′ has a capacity of 10,500 pounds for an average cement slurry mix. The cement or other material is contained in tank 43 which may have a capacity of 40,000 pounds and a spiral center drive 45 for feeding purposes. Valve 47 may be manually or computer controlled to feed a metered amount of cement into container 11′.

Tank 53 is provided for holding water and may have a capacity of 40,000 pounds for flow through metering valve 55 into filter 57 and thence into containter 11′. The fluid metering systems and valves are conventional, as is the material control tie-in 59 between water valve 55 and further water valve 61 which meters spray water to spray ring 63. Spray ring 63 merely has holes oriented at various angles to cause the high pressure water to clean the walls and top of the container 11′. The valve control tie-in adds the amount of water from both sources.

The air filter 57 uses an open cell foam or other filtering materials to trap the dust. Upon each recycle, the water or fluids entering the mixing container 11′ from tank 53 wash the filter clean. This is in effect a self-cleaning air filter system. The small ½ psi vacuum pump 65 exhausts air, via the filter 57 from container 11′ displaced by cement and water. Container 11′ is preferably filled about three-quarters full for optimum mixing action. The light vacuum pump pressure prevents any back pressure to all feeds in the system and prevents any dust from escaping. The vacuum system is turned on after fluids are in the mixing container, and at the time of metering in the dry materials.

Also, it is interesting to note that in the northern hemisphere the impellers, such as 33, are rotated clockwise, whereas in the southern hemisphere they are rotated counter-clockwise to enhance the efficiency and decrease the power requirements, measured in motor amps.

A dump valve 71 controls discharge of the creamy slurry via conduit 73 into a sand and gravel conduit 75 which includes an internal preliminary mixing vane 77. A hopper 78, which may be conveyer fed, introduces the sand and gravel into conduit 79 which is coupled by coupling 81 to conduit 75. The slurry sand and gravel, mixed by internal preliminary mixing vane 77, is discharged to a secondary mixer 79 which may in fact comprise a ready-mix truck as is shown in FIG. 4 or may employ a hydraulic dump valve 84 and conventional mixing for on the site construction or chute discharge.

Figure 4:
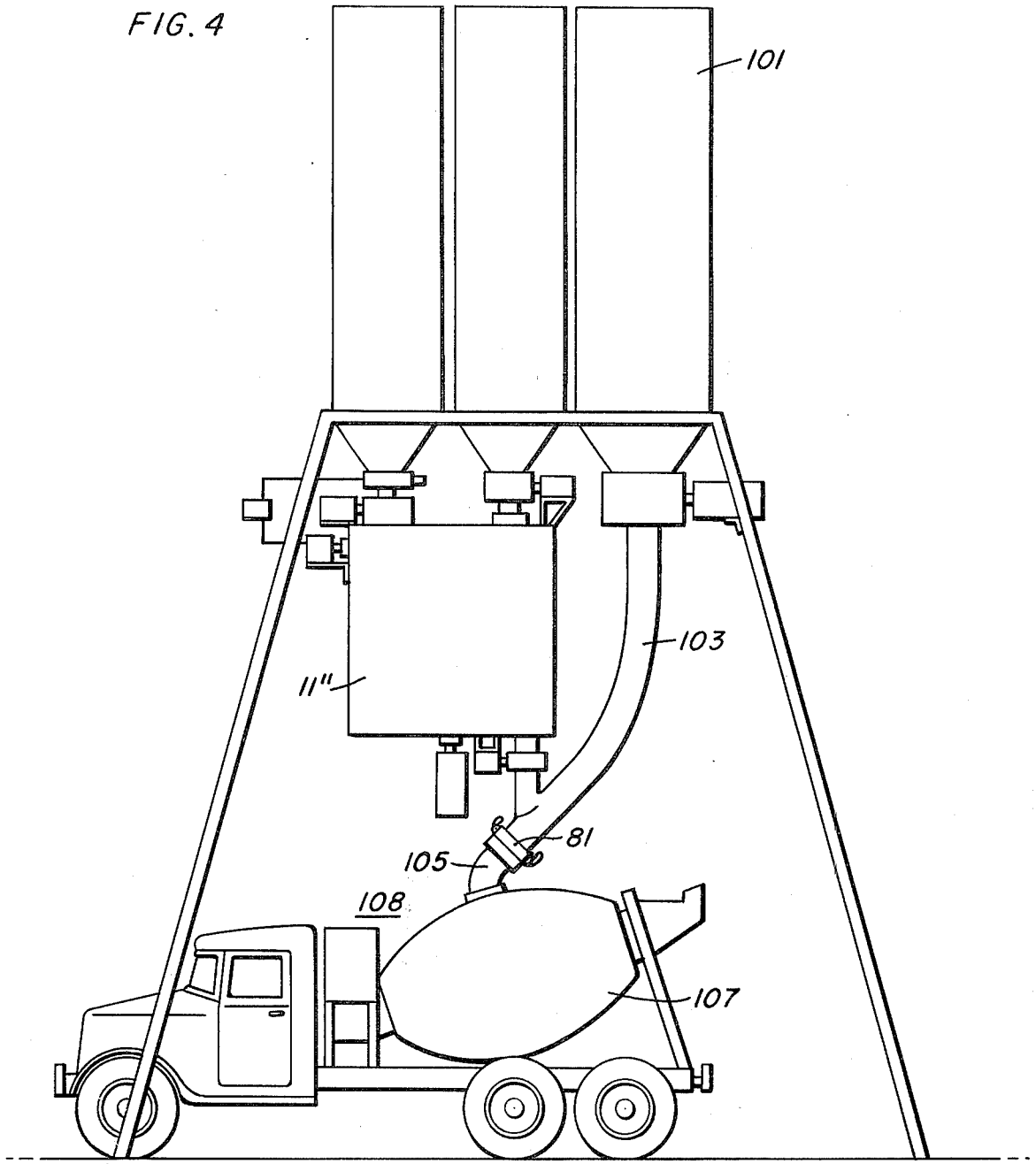
FIG. 4 is a similar apparatus to that of FIG. 3 but showing the cement slurry and aggregates loaded onto a ready-mix truck.

In FIG. 4, a third tank 101 is added for sand and gravel to supply the conduit 103 for receipt of the creamed slurry from container 11''. The flexible coupling 81 and hose 105 permit the aggregate and slurry to reach secondary mixer 107 of concrete truck 108.

In FIG. 4*a* the details of the coupling 81 are shown wherein conduit 79 is connected to conduit 77, by rotating the cammed levers 102 and 104 to lock the neck portion, such as 109, beneath the camming portions of levers 102 and 104.

Otherwise, the arrangement of FIG. 4 is similar to that of FIG. 3, already explained. However, it should be pointed out that the various materials may be placed in any of the tanks for combining, such as foaming or dry mixing or paint mixing, etc.

In any event, the rpm of the secondary mixer, such as conduit 103, is set so that continuous movement of the materials is created. If this rpm is too fast, materials will be forced against the pipe walls by centrifugal action and will not move down the pipe. A conventional drive (not shown) is provided for the mixer.

While normally a single impeller will suffice for efficient mixing of average mixes, it is desirable for heavier viscous materials to stack two or more impellers. Stacking forces the materials to be mixed down for complete combining with other dissimilar materials.

In the preferred method the steps are as follows:

1. start the motor;
2. spray clean the container;
3. admit the fluids;
4. admit the dry materials and start the vacuum;
5. mix for a preferred 2 or 3 minute period; and
6. dump.

In the event of dry mixing only, the ingredients may be admitted simultaneously as is also the case in mixing fluid materials, but in the latter event the vane is not necessary.

What is claimed is:

1. A dustless mixing method using a closed container supplied with materials to be combined comprising the steps of:

a. metering a first material into the container;
b. establishing a vortex in the metered material;
c. developing a vacuum in the container to draw off air displaced by said materials;
d. metering further material to the container; and
e. mixing said materials through the use of said vortex.

2. The method of claim 1 wherein said first material is a fluid, and comprising the further step of:

spray cleaning the container with said fluid metered under pressure and combining the volume of spray cleaning fluid used in cleaning with the volume metered to determine the total amount of fluid metered into the container.

3. The method of claim 2 wherein the further material is cementitious, and comprising the further step of:

filtering the air evacuated from the container to trap any cementitious dust.

4. The method of claim 3 comprising the further step of:

admitting the first metered fluid material into the container through the filter to recover the trapped cementitious material.

5. The method of claim 4 comprising the further step of applying the mixed materials to sand and gravel and secondarily mixing the sand and gravel and mixed materials.

6. The dustless mixing method including creating a creamy slurry of water and cement in a container through the use of one or more concave impellers rotating in the container to cause vortex-type mixing without generating heat, comprising the steps of:

a. spraying the container interior with metered spray water;
b. establishing rotation of the impeller;
c. metering the water into the container for establishment of the vortex;
d. metering the cement into the container for combination with the water to create the creamy slurry;
e. exhausting and filtering the air displaced in the container to trap any cement dust;
f. mixing said water and cement for a predetermined interval;
g. discharging said slurry onto moving sand and gravel aggregate;
h. secondarily mixing the slurry with said sand and gravel aggregates to produce concrete; and
i. the said metered water step washing the trapped dust back into the container for use during the next cycle.

7. Apparatus for dustless mixing of materials comprising in combination:

a. a mixing container;
b. one or more symmetrical impellers mounted for rotation within said container;
c. means for rotating said impellers at a predetermined rpm;
d. means for metering a first material into said container, said impellers establishing agitation of the metered material;
e. means for metering further material to the container for mixing with said first metered material through the use of said impellers;
f. said first material being a fluid and further comprising means for spray cleaning the container with said fluid metered under pressure; and,
g. means for combining a measurement of the metered volume of spray cleaning fluid along with a measurement of the volume of fluid metered to determine the total amount of fluid metered into the container.

8. Apparatus for dustless mixing of water and cement into a creamy slurry through the use of vortex-type mixing without generating heat, comprising in combination:

a. a mixing container;
b. a plurality of symmetrical concave impellers of like diameters stacked in spaced apart positions upwardly of the container bottom and mounted for rotation;

c. means for rotating the impellers at a velocity of approximately 30 miles per hour tip speed;
d. means for spraying the interior of the container with spray water to wash it;
e. means for metering slurry forming water into the container for the establishment of the vortex;
f. means for metering the cement into the container for combination with the water to create the creamy slurry;
g. vane means within the container and against a portion of the periphery thereof for modifying the turbulence of the vortex by redirecting the slurry;
h. foam cell filtering means in communication with the container;
i. means for evacuating air from the container through the filter means to trap cement dust;
j. means for directing the metered water through the filter means to return the trapped cement dust to the container on a succeeding cycle; and
k. means for discharging said slurry on moving sand and gravel aggregates for further mixing thereof.

9. Apparatus for dustless mixing of materials comprising in combination:
a. a mixing container;
b. one or more symmetrical impellers mounted for rotation within said container;
c. means for rotating said impellers at a predetermined rpm;
d. means for metering a first material into said container, said impellers establishing a vortex in the metered material;
e. means for metering further material to the container for mixing with said first metered material through the use of said vortex;
f. said first material being a fluid and further comprising means for spray cleaning the container with said fluid metered under pressure; and,
g. means for combining a measurement of the volume of spray cleaning fluid along with a measurement of the volume of fluid metered to determine the total amount of fluid metered into the container.

10. The apparatus of claim 9 wherein the further material is cementitious and further comprising means for filtering and evacuating displaced air from the container to trap any cementitious dust.

11. The apparatus of claim 10 further comprising means for admitting the first metered fluid material into the container through said filter to recover the trapped cementitious material by delivering it into the container.

12. The apparatus of claim 11 further comprising means for applying the mixed materials to sand and gravel; and secondary mixing means for mixing the sand and gravel and mixed materials.

13. A dustless mixing method using a closed container supplied with materials to be combined comprising the steps of:
a. metering a first material into the container;
b. establishing agitation in the metered material;
c. metering further material to the container;
d. developing a vacuum in the container to draw off air displaced by said materials as the materials enter the container; and
e. mixing said materials within the container.

14. The method of claim 13 wherein said first material is a fluid, and comprising the further step of:
spray cleaning the container with said fluid metered under pressure and combining the volume of spray cleaning fluid used in cleaning with the volume metered to determine the total amount of fluid metered into the container.

15. The method of claim 14 wherein the further material is cementitious, and comprising the further step of:
filtering the air evacuated from the container to trap any cementitious dust.

16. The method of claim 15 comprising the further step of:
admitting the first metered fluid material into the container through the filter to recover the trapped cementitious material.

17. The method of claim 16 comprising the further step of applying the mixed materials to sand and gravel and secondarily mixing the sand and gravel and mixed materials.

* * * * *